US008356669B2

(12) United States Patent
Holderman

(10) Patent No.: US 8,356,669 B2
(45) Date of Patent: Jan. 22, 2013

(54) DOWNHOLE ADJUSTABLE INFLOW CONTROL DEVICE FOR USE IN A SUBTERRANEAN WELL

(75) Inventor: Luke W. Holderman, Plano, TX (US)

(73) Assignee: Halliburton Energy Services, Inc., Houtson, TX (US)

( * ) Notice: Subject to any disclaimer, the term of this patent is extended or adjusted under 35 U.S.C. 154(b) by 153 days.

(21) Appl. No.: 12/873,840

(22) Filed: Sep. 1, 2010

(65) Prior Publication Data

US 2012/0048561 A1 Mar. 1, 2012

(51) Int. Cl.
*E21B 34/00* (2006.01)

(52) U.S. Cl. ..... 166/316; 166/334.1; 166/155; 166/373

(58) Field of Classification Search ..... 166/334.1, 166/316, 155, 236, 373, 205, 66.7
See application file for complete search history.

(56) References Cited

U.S. PATENT DOCUMENTS

| | | | | |
|---|---|---|---|---|
| 6,622,794 | B2 * | 9/2003 | Zisk, Jr. | 166/373 |
| 7,469,743 | B2 | 12/2008 | Richards | |
| 7,559,375 | B2 | 7/2009 | Dybevik et al. | |
| 7,708,068 | B2 | 5/2010 | Hailey, Jr. | |
| 7,802,621 | B2 | 9/2010 | Richards et al. | |
| 2006/0027377 | A1 | 2/2006 | Schoonderbeek et al. | |
| 2008/0283238 | A1 | 11/2008 | Richards et al. | |
| 2008/0314590 | A1 | 12/2008 | Patel | |
| 2009/0000787 | A1 | 1/2009 | Hill et al. | |
| 2009/0151925 | A1 | 6/2009 | Richards et al. | |
| 2009/0218103 | A1 | 9/2009 | Aakre et al. | |

OTHER PUBLICATIONS

Halliburton; "Simulation Software for EquiFlow® IDC Completions", H07010, dated Sep. 2009, 2 pages.
Schlumberger; "FluxRite Inflow Control Device", 09-SM-0010, dated 2009, 2 pages.
Tejas; "Inflow Control Device Technology", undated, 2 pages.
Weatherford; "Combating Coning by Creating Even Flow Distribution in Horizontal Sand-Control Completions", 2980.02, dated 2005-2008, 4 pages.
International Search Report with Written Opinion issued Jan. 5, 2012 for PCT Patent Application No. PCT/US11/047939, 8 pages.
International Search Report with Written Opinion issued Feb. 17, 2012 for International Patent Application No. PCT/US11/047225, 8 pages.
Specification and Drawings for PCT Patent Application No. PCT/US11/47225, filed Aug. 10, 2011, 22 pages.
Office Action issued Jun. 5, 2012 for U.S. Appl. No. 13/430,370, 10 pages.
Specification and Drawings for U.S. Appl. No. 13/557,934, filed Jul. 25, 2012, 25 pages.
Office Action issued Oct. 19, 2012, for U.S. Appl. No. 13/557,934, 18 pages.

* cited by examiner

*Primary Examiner* — William P Neuder
*Assistant Examiner* — Yong-Suk(Philip) Ro
(74) *Attorney, Agent, or Firm* — Smith IP Services, P.C.

(57) ABSTRACT

A well system can include an inflow control device which resists flow into a tubular string. A selection from among multiple different flow resistances through the inflow control device can be performed in response to pressure manipulation. An inflow control device can include a piston which is displaceable to at least two positions. Flow through the inflow control device is permitted at a certain flow resistance when the piston is at one position, and flow through the inflow control device is permitted at a greater flow resistance when the piston is at another position. Fluid which flows through the inflow control device can be constrained to flow through an increased number of flow restrictors in response to displacement of the piston from the first to the second position.

2 Claims, 4 Drawing Sheets

DOWNHOLE ADJUSTABLE INFLOW CONTROL DEVICE FOR USE IN A SUBTERRANEAN WELL

BACKGROUND

This disclosure relates generally to equipment utilized and operations performed in conjunction with a subterranean well and, in an example described below, more particularly provides a downhole adjustable inflow control device.

In a hydrocarbon production well, it is many times beneficial to be able to regulate flow of fluids from an earth formation into a wellbore. A variety of purposes may be served by such regulation, including prevention of water or gas coning, minimizing sand production, minimizing water and/or gas production, maximizing oil production, balancing production among zones, etc.

Therefore, it will be appreciated that advancements in the art of adjusting flow restriction in a well would be desirable in the circumstances mentioned above, and such advancements would also be beneficial in a wide variety of other circumstances.

SUMMARY

In the disclosure below, a downhole adjustable inflow control device and associated well system are provided which bring improvements to the art of variably restricting fluid flow in a well. One example is described below in which a resistance to flow through an inflow control device can be conveniently adjusted downhole by varying the number of flow restrictors through which fluid is constrained to flow.

In one aspect, a well system is provided to the art by the disclosure below. The well system can include an inflow control device which resists flow into a tubular string. A selection from among multiple different flow resistances through the inflow control device is performed in response to pressure manipulation.

In another aspect, an inflow control device is provided for use in a subterranean well. The inflow control device can include a piston which is displaceable to at least two positions. Flow through the inflow control device is permitted at a first flow resistance when the piston is at a first position, and flow through the inflow control device is permitted at a second flow resistance when the piston is at a second position. The second flow resistance is greater than the first flow resistance.

In yet another aspect, an inflow control device for use in a subterranean well is provided which includes a piston which is displaceable to at least first and second positions. Fluid which flows through the inflow control device is constrained to flow through an increased number of flow restrictors in response to displacement of the piston from the first to the second position.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
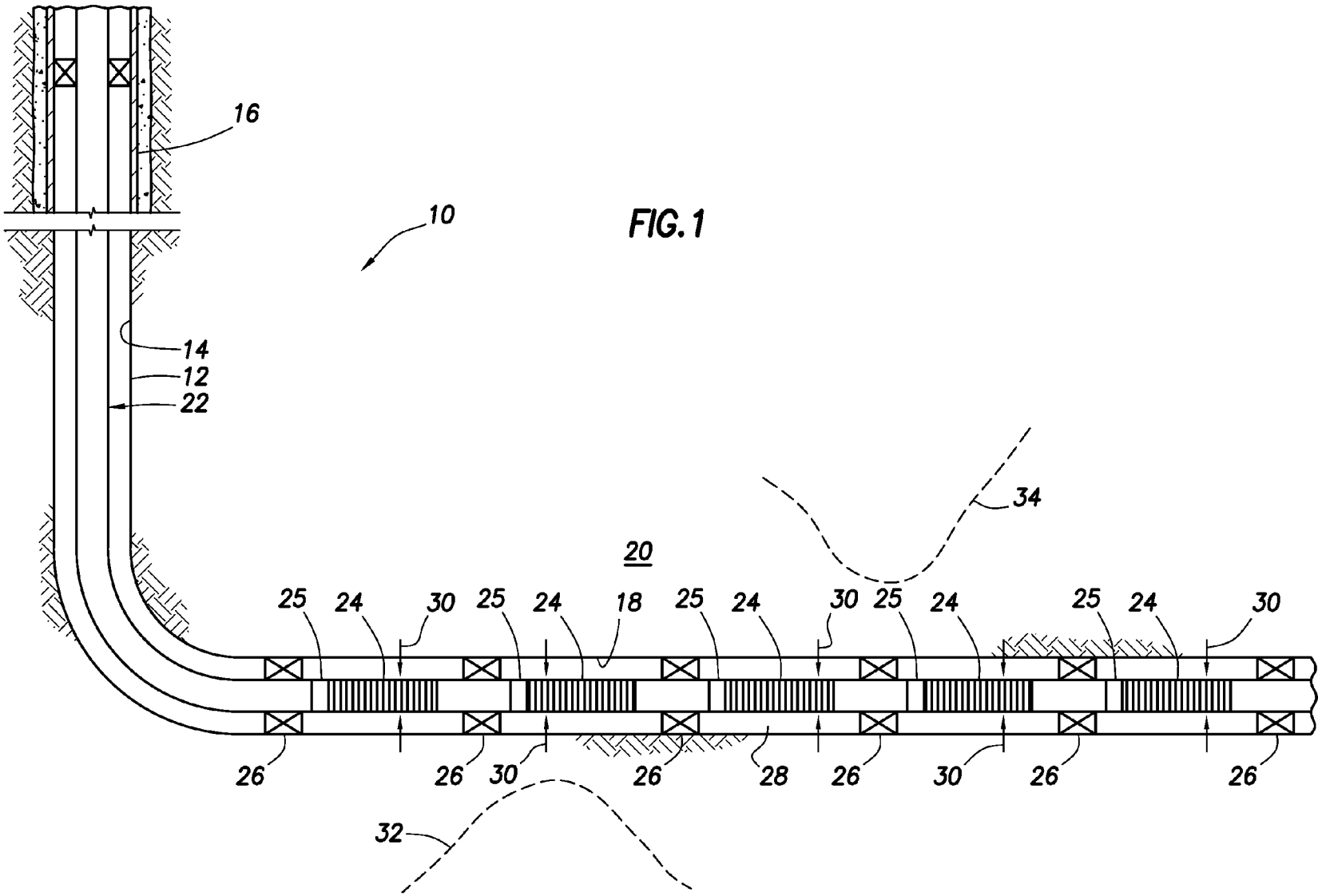
FIG. 1 is a schematic partially cross-sectional view of a well system which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, adjustable inflow control devices 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and an adjustable inflow control device 25 are interconnected in the tubular string 22. The well screen 24 filters the fluids 30 flowing into the tubular string 22 from the annulus 28. The inflow control device 25 restricts flow of the fluids 30 into the tubular string 22, with the level of flow restriction being adjustable downhole.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be both injected into and produced from a formation, fluids could be produced from multiple formations, etc.

It is not necessary for one each of the well screen 24 and inflow control device 25 to be positioned between each adjacent pair of the packers 26. It is not necessary for a single inflow control device 25 to be used in conjunction with a single well screen 24. Any number, arrangement and/or combination of these components may be used.

It is not necessary for any inflow control device 25 to be used with a well screen 24.

It is not necessary for the well screens 24, inflow control devices 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from multiple zones, minimizing production of undesired fluids, minimizing production of sand, minimizing damage to the formation 20, maximizing production of desired fluids, etc.

Examples of the inflow control devices 25 described more fully below can provide these benefits by increasing resistance to flow to thereby balance flow among zones, prevent water or gas coning, etc., or by increasing resistance to flow or preventing flow to thereby restrict production of an undesired fluid (such as water or gas in an oil producing well, or water in a gas producing well), etc.

Note that, at downhole temperatures and pressures, hydrocarbon gas can actually be completely or partially in liquid phase. Thus, it should be understood that when the term "gas" is used herein, the supercritical, liquid, condensate and/or gaseous phases are included within the scope of that term.

Figure 2:
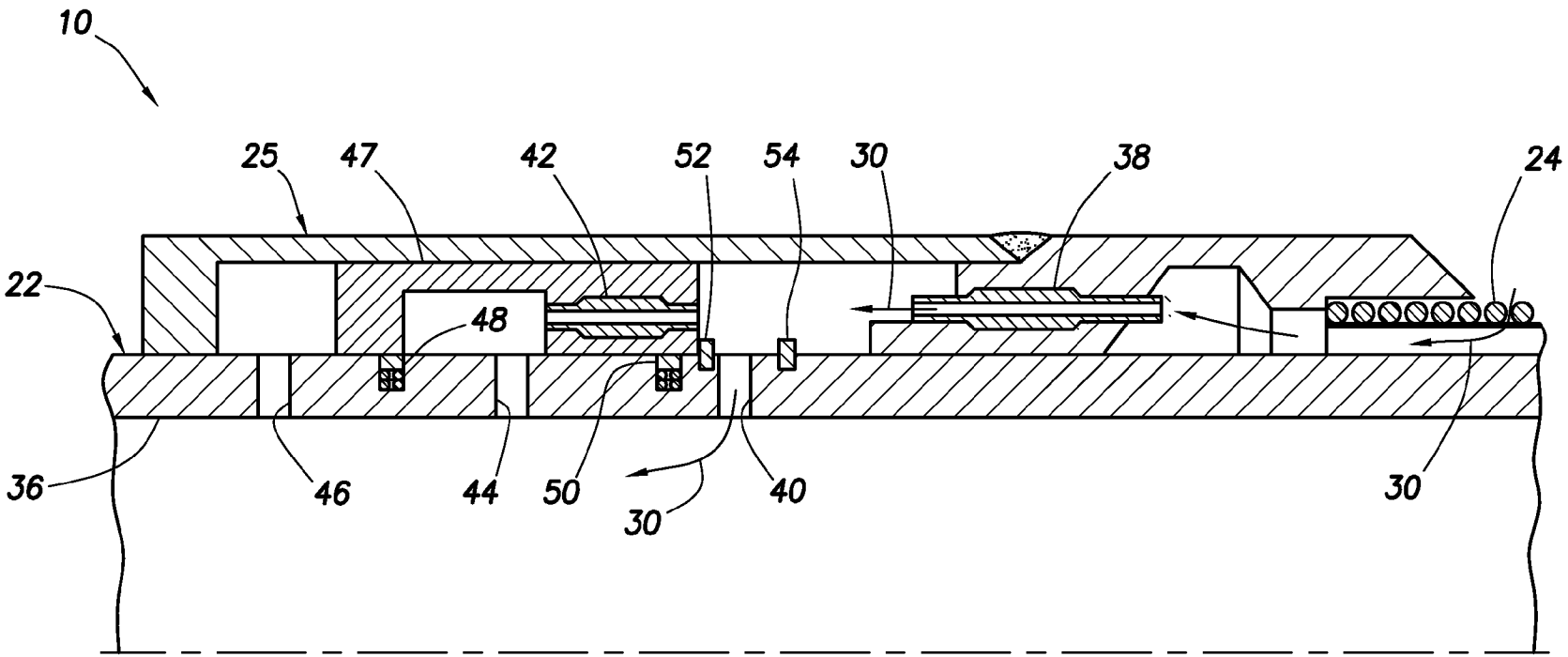
FIG. 2 is an enlarged scale schematic cross-sectional view of an inflow control device which may be used in the well system of FIG. 1, the inflow control device being depicted in a reduced flow resistance configuration.

Referring additionally now to FIG. 2, an enlarged scale cross-sectional view of one of the inflow control devices 25 is representatively illustrated. In this example, the fluid 30 flows first through the well screen 24, and then through the inflow control device 25 to an interior flow passage 36. The flow passage 36 extends longitudinally through the well screen 24, inflow control device 25, and the remainder of the tubular string 22.

As depicted in FIG. 2, the fluid 30 flows through a flow restrictor 38 of the inflow control device 25 before flowing through an opening 40 to the flow passage 36 for production via the tubular string 22. The flow restrictor 38 is illustrated in the form of a tube having a relatively small inner diameter, but other numbers and/or types of flow restrictors (e.g., orifices, tortuous paths, vortex chambers, etc.) may be used, if desired.

Another flow restrictor 42 and opening are provided in the inflow control device 25, but since these present an increased flow resistance path for flow of the fluid 30, a substantial majority of the fluid instead flows through the opening 40 to the flow passage 36 and does not flow through the flow restrictor 42. In other examples, flow of the fluid 30 through the flow restrictor 42 and opening 44 could be entirely prevented (e.g., using an appropriate valve device) in the configuration of FIG. 2.

As with the flow restrictor 38, the flow restrictor 42 can be provided as any type or number of flow restrictors. The flow restrictor 42 is preferably carried on a piston 47 and displaces therewith. The piston 47 is used to selectively permit and prevent flow through the openings 40, 44.

Another opening 46 is provided for applying a pressure differential to the piston 47, as described more fully below. Snap rings, spring-loaded lugs or other types of locking devices 48, 50 prevent displacement of the piston 47 to the left (as viewed in FIG. 2) after it has displaced certain respective distances. Shear pins, shear screws or other types of release devices 52, 54 permit displacement of the piston 47 to the right (as viewed in FIG. 2) in response to respective predetermined pressure differentials being applied across the piston.

Note that it is not necessary for the inflow control device 25 to include the flow restrictor 38, or any substantial restriction to flow in the FIG. 2 configuration. Instead, substantially unrestricted flow of the fluid 30 through the inflow control device 25 could be permitted in the FIG. 2 configuration.

The FIG. 2 configuration may be used when substantially unrestricted flow from the formation 20 to the interior of the tubular string 22 is desired for a particular zone, for example, when there is little or no likelihood of water coning 32 or gas coning 34, or when little or no undesired fluid is being produced from the zone, etc. The flow restrictor 38 may be used to provide a particular desired level of flow restriction in the FIG. 2 configuration, in order to prevent water coning 32 or gas coning 34, and/or to restrict production of undesired fluid, etc.

Figure 3:
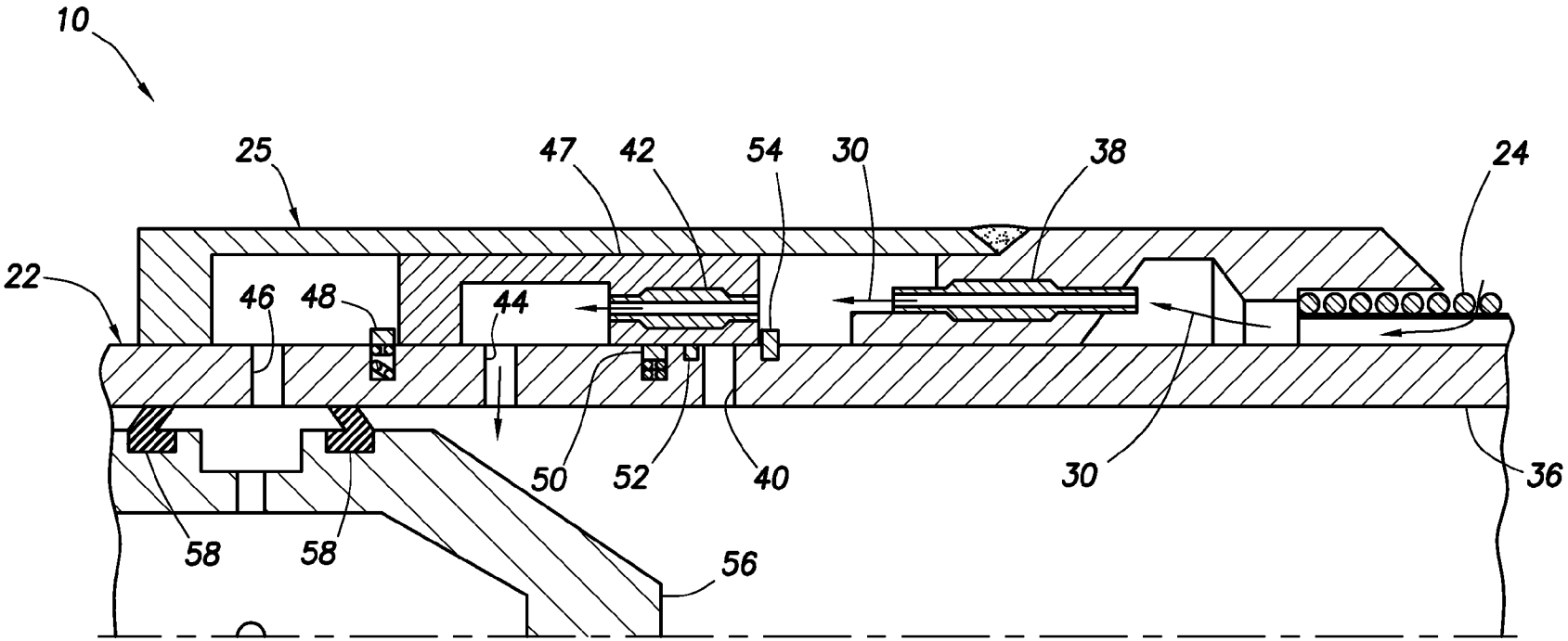
FIG. 3 is a schematic cross-sectional view of the inflow control device, depicted in an increased flow resistance configuration.

Referring additionally now to FIG. 3, the inflow control device 25 is representatively illustrated after the piston 47 has displaced somewhat to the right in response to a first pressure differential having been applied across the piston. To apply the pressure differential to the piston 47, a tool 56 is conveyed into the passage 36. The tool 56 has seals 58 which straddle the opening 46 when the tool is appropriately positioned in the inflow control device 25.

The tool 56 could be conveyed by a coiled tubing string (not shown) into the tubular string 22, in which case increased pressure could be applied to the interior of the coiled tubing string after positioning the tool in the inflow control device 25. This increased pressure would be transmitted via the tool 56 and opening 46 to the left side of the piston 47, thereby biasing the piston to the right (as viewed in FIG. 3).

In another example, the tool 56 could be conveyed by wireline or slickline, and could include a pump or compressed gas chamber for applying the pressure differential across the piston 47. Note that it is not necessary for an increased pressure to be applied to the piston 47, since in other examples a reduced pressure could be applied in order to create a desired pressure differential across the piston.

When a predetermined pressure differential is created across the piston 47, the release device 52 will release the piston for displacement to the right as depicted in FIG. 3. This displacement of the piston 47 prevents (or at least severely restricts) flow through the opening 40. Thus, the fluid 30 is now constrained to flow through the flow restrictor 42 after flowing through the flow restrictor 38.

The locking device 48 prevents the piston 47 from displacing to the left out of its position blocking flow through the opening 40. In addition, the release device 54 prevents further displacement of the piston 47 to the right, unless a further increased pressure differential is applied across the piston.

Note that the tool 56 would preferably not remain in the flow passage 36 while the fluid 30 flows through the opening 44 into the flow passage. Instead, if it is intended for the piston 47 to remain in the position depicted in FIG. 3 after the tool 56 has been used to apply the pressure differential across the piston, then the tool would preferably be retrieved from the tubular string 22.

Note, also, that the resistance to flow through the inflow control device 25 is increased in the configuration of FIG. 3, as compared to the configuration of FIG. 2. This is due to the fact that the fluid 30 is constrained to flow through both of the flow restrictors 38, 42, instead of being able to flow through only one of the flow restrictors as in the configuration of FIG. 2. Of course, the increase in the number of flow restrictors could be from zero to one, from one to two, from two to three, from five to ten, or any other numerical increase in flow restrictors, depending on how many of each of the flow restrictors 38, 42 is provided.

The FIG. 3 configuration may be used to provide an increased level of flow restriction, for example, when water coning 32 or gas coning 34 has been detected, when an unacceptable amount of undesired fluid is being produced, etc. The ability to adjust the resistance to flow through the inflow control device 25 downhole is a significant advantage in these circumstances.

Figure 4:
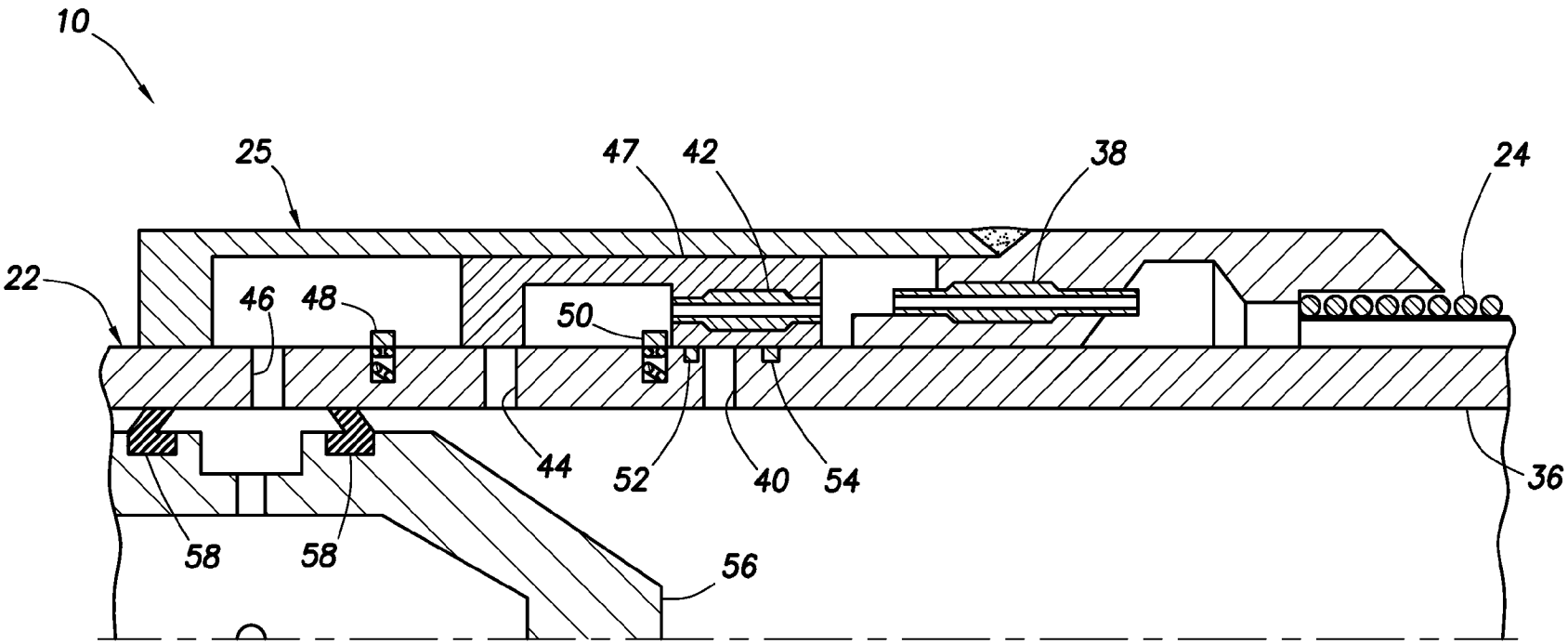
FIG. 4 is a schematic cross-sectional view of the inflow control device, depicted in a flow prevention configuration.

Referring additionally now to FIG. 4, the inflow control device 25 is representatively illustrated in a configuration in which flow through the inflow control device is prevented. An increased pressure differential has been applied to the piston 47 via the tool 56 to thereby displace the piston further to the right (as viewed in FIG. 4). Flow through both of the openings 40, 44 is now blocked by the piston 47.

The increased pressure differential (preferably greater than that required to displace the piston 47 from the FIG. 2 configuration to the FIG. 3 configuration) causes the release device 54 to release, thereby permitting the piston to displace to the right. After being displaced to the right as depicted in FIG. 4, the locking device 50 prevents subsequent leftward displacement of the piston 47.

This configuration of the inflow control device 25 may be used when it is desired to entirely prevent production of fluid 30 from a particular zone. For example, this configuration may be used when water coning 32 or gas coning 34 has made further production from the zone unwise, when an unacceptable amount of undesired fluid is being produced from the zone, etc.

Note that it is not necessary for the tool 56 to be separately conveyed into the passage 36 in order to displace the piston 47 from its FIG. 2 position to its FIG. 3 position, and then from its FIG. 3 position to its FIG. 4 position. The piston 47 could be displaced from its FIG. 2 position to its FIG. 4 position using only a single trip of the tool 56 into the tubular string 22.

The inflow control device 25 can be supplied with appropriate seals (not shown) to seal off each of the openings 40, 44 when the piston 47 is appropriately positioned, to permit the pressure differentials to be applied across the piston, etc. For example, seals could be provided straddling each of the openings 40, 44, and a seal could be provided on an outer side of the piston 47.

It may now be fully appreciated that the above disclosure provides significant advancements to the art of variably restricting fluid flow into a tubular string. The inflow control device 25 described above can be adjusted downhole to thereby vary the level of flow resistance through the inflow control device, or to completely prevent flow through the inflow control device. Such adjustments can be conveniently performed while the inflow control device 25 is downhole.

The above disclosure provides to the art a well system 10 including an inflow control device 25 which resists flow into a tubular string 22. A selection from among multiple different flow resistances through the inflow control device 25 can be performed in response to pressure manipulation.

The pressure manipulation can include an increased pressure applied to the inflow control device 25.

The pressure manipulation can be performed from a remote location (such as the earth's surface).

The pressure manipulation may be performed via a tool 56 conveyed into the tubular string 22.

The pressure manipulation may displace a piston 47 of the inflow control device 25.

Fluid 30 which flows through the inflow control device 25 can be constrained to flow through multiple flow restrictors 38, 42 in response to the pressure manipulation.

Fluid 30 which flows through the inflow control device 25 can be constrained to flow through an increased number of flow restrictors 38, 42 in response to the pressure manipulation.

Preferably, fluid 30 which flows through the inflow control device 25 also flows through a well screen 24.

The above disclosure also describes an inflow control device 25 for use in a subterranean well, with the inflow control device 25 comprising a piston 47 which is displaceable to at least first and second positions. Flow through the inflow control device 25 is permitted at a first flow resistance when the piston 47 is at the first position, and flow through the inflow control device 25 is permitted at a second flow resistance when the piston 47 is at the second position. The second flow resistance is preferably greater than the first flow resistance.

The piston 47 may displace between the first and second positions in response to a pressure differential applied to the piston 47.

The piston i47 may be displaceable to a third position in which flow through the inflow control device 25 is prevented.

The inflow control device 25 can include a tool 25 which directs pressure from a remote location to the piston 47.

The piston 47 may displace in response to pressure applied from an interior flow passage 36 of a tubular string 22.

Fluid 30 which flows through the inflow control device 25 may be constrained to flow through multiple flow restrictors 38, 42 in response to displacement of the piston 47 to the second position.

Fluid 30 which flows through the inflow control device 25 may be constrained to flow through an increased number of flow restrictors 38, 42 in response to displacement of the piston 47 from the first to the second position.

An inflow control device 25 described above for use in a subterranean well can include a piston 47 which is displaceable to at least first and second positions. Fluid 30 which flows through the inflow control device 25 is preferably constrained to flow through an increased number of flow restrictors 38, 42 in response to displacement of the piston 47 from the first to the second position.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," "leftward," "rightward," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. An inflow control device for use in a subterranean well, the inflow control device comprising:

a piston which is displaceable in a same direction from a first position to a second position, and from the second position to a third position;

flow through the inflow control device being permitted at a first flow resistance when the piston is at the first position;

flow through the inflow control device being permitted at a second flow resistance when the piston is at the second position, the second flow resistance being greater than the first flow resistance; and flow through the inflow control device being prevented when the piston is at the third position.

2. An inflow control device for use in a subterranean well, the inflow control device comprising:

a piston which is displaceable in a same direction from a first position to a second position, and from the second position to a third position;

wherein fluid which flows through the inflow control device is constrained to flow through an increased number of flow restrictors in response to displacement of the piston from the first position to the second position, and wherein flow through the inflow control device is prevented in response to displacement of the piston from the second position to the third position.

* * * * *